US012369646B2

(12) United States Patent
Bilat et al.

(10) Patent No.: US 12,369,646 B2
(45) Date of Patent: Jul. 29, 2025

(54) DETECTION OF ADVERSE HEATER CONDITIONS IN AN ELECTRICALLY HEATED AEROSOL GENERATING SYSTEM

(71) Applicant: Philip Morris Products S.A., Neuchatel (CH)

(72) Inventors: Stephane Bilat, Neuchatel (CH); Guillaume Colotte, Neuchatel (CH); Daryl Ng Wai Leong, Singapore (SG); Ho Keat Chang, Singapore (SG)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 18/618,459

(22) Filed: Mar. 27, 2024

(65) Prior Publication Data

US 2024/0225123 A1 Jul. 11, 2024

Related U.S. Application Data

(63) Continuation of application No. 17/057,901, filed as application No. PCT/EP2019/063266 on May 22, 2019, now Pat. No. 12,089,654.

(30) Foreign Application Priority Data

May 30, 2018 (EP) ..... 18175207

(51) Int. Cl.
*A24F 40/53* (2020.01)
*A24F 40/51* (2020.01)
(Continued)

(52) U.S. Cl.
CPC ..... *A24F 40/53* (2020.01); *A24F 40/51* (2020.01); *A24F 40/57* (2020.01); *A24F 40/10* (2020.01)

(58) Field of Classification Search
None
See application file for complete search history.

(56) References Cited

U.S. PATENT DOCUMENTS 9,974,334 B2 5/2018 Dooly
2014/0345606 A1 11/2014 Talon
(Continued)

FOREIGN PATENT DOCUMENTS

CN 104010530 A 8/2014
CN 106604654 A 4/2017
(Continued)

OTHER PUBLICATIONS

Japanese Office Action issued on Dec. 10, 2024 in Japanese Patent Application No. 2023-189280 (with unedited computer-generated English translation), 5 pages.
(Continued)

*Primary Examiner* — Ross N Gushi
(74) *Attorney, Agent, or Firm* — Oblon, McClelland, Maier & Neustadt, L.L.P.

(57) ABSTRACT

An electrically operated aerosol-generating system is provided, including: a heating element; a power supply; a temperature sensor; electric circuitry in communication with the heating element, temperature sensor, and the power supply, the circuitry including a memory to regulate a supply of power based on the measured temperature, determine an adverse condition when a rate of change of power supplied to reach or maintain a predetermined temperature falls outside a predefined range stored in the memory, and control power supplied based on whether there is an adverse condition or provide an indication when there is an adverse condition; and a device and a removable cartridge, the power supply and the circuitry being in the device and the heating element being in the cartridge, the cartridge including a liquid aerosol-forming substrate, and the circuitry is further
(Continued)

to determine an adverse condition only after the temperature is at a target temperature.

6 Claims, 5 Drawing Sheets

(51) Int. Cl.
*A24F 40/57* (2020.01)
*A24F 40/10* (2020.01)

(56) References Cited

U.S. PATENT DOCUMENTS

| | | | |
|---|---|---|---|
| 2014/0345633 | A1 | 11/2014 | Talon |
| 2015/0237916 | A1 | 8/2015 | Farine et al. |
| 2016/0331038 | A1 | 11/2016 | Farine et al. |
| 2017/0251725 | A1 | 9/2017 | Buchberger et al. |
| 2018/0042306 | A1 | 2/2018 | Atkins et al. |
| 2018/0116292 | A1 | 5/2018 | Atkins |

FOREIGN PATENT DOCUMENTS

| | | | |
|---|---|---|---|
| CN | 109789285 | A | 5/2019 |
| EA | 019736 | B1 | 5/2014 |
| EA | 025718 | B1 | 1/2017 |
| JP | 2015-507476 | A | 3/2015 |
| JP | 2015-507477 | A | 3/2015 |
| JP | 2015-531600 | A | 11/2015 |
| JP | 2017-514463 | A | 6/2017 |
| JP | 2017-532011 | A | 11/2017 |
| RU | 2 606 942 | C2 | 1/2017 |
| WO | WO 2012/085203 | A1 | 6/2012 |
| WO | WO 2013/098396 | A2 | 7/2013 |
| WO | WO 2014/040988 | A2 | 3/2014 |
| WO | 2529629 | A | 3/2016 |
| WO | WO 2016/150922 | A2 | 9/2016 |
| WO | WO 2018/019533 | A1 | 2/2018 |
| WO | WO 2018/027189 | A2 | 2/2018 |

OTHER PUBLICATIONS

International Search Report and Written Opinion issued on Aug. 12, 2019 in PCT/EP2019/063266 filed on May 22, 2019.

Combined Russian Office Action and Search Report issued Sep. 7, 2022 in Russian Patent Application No. 2020140006/03 (with unedited computer-generated English Translation), 17 pages.

Combined Chinese Office Action and Search Report issued on Jun. 16, 2023 in Chinese Patent Application No. 201980030658.8 (with English translation), 15 pages.

Japanese Office Action issued on Jun. 26, 2023 in Japanese Patent Application No. 2020-562176 (with English translation), 6 pages.

Japanese Notice of Allowance issued Oct. 5, 2023 in Japanese Patent Application No. 2020-562176 (with English Translation), 4 pages.

DETECTION OF ADVERSE HEATER CONDITIONS IN AN ELECTRICALLY HEATED AEROSOL GENERATING SYSTEM

CROSS REFERENCE TO RELATED APPLICATIONS

This application is a continuation of and claims benefit under 35 U.S.C. § 120 to U.S. application Ser. No. 17/057,901, filed Nov. 23, 2020, which is a U.S. national stage application of PCT/EP2019/063266, filed on May 22, 2019, and claims the benefit of priority under 35 U.S.C. § 119 from EP 18175207.2, filed on May 30, 2018, the entire contents of each of which are incorporated herein by reference.

TECHNICAL FIELD

The present invention relates to aerosol generating systems. In particular, the invention relates to detection of a dry heating element or other undesirable condition in an aerosol generating system.

DESCRIPTION OF THE RELATED ART

In some aerosol-generating devices, a liquid aerosol-forming substrate is delivered from a liquid storage portion to an electrical heating element. Upon heating to a target temperature, the aerosol-forming substrate vaporises to form an aerosol. The liquid substrate is usually delivered to the heating element by a wick. When the amount of aerosol-forming substrate in the wick is depleted, the heating element may overheat, negatively affecting the aerosol quality. This is particularly important in aerosol-generating systems that are configured to generate an aerosol for user inhalation.

WO2012/085203 discloses an aerosol-generating system that monitors a temperature rise at the heating element, wherein a rapid increase in heater temperature indicates drying out at the wick. More specifically, the system compares the rate of temperature rise with a threshold value stored in a memory. If the rate of temperature rise exceeds the threshold value the system ceases the power supply to the heating element. The device as disclosed in WO2012/085203 monitors the heater temperature based on the electrical resistance of the heater, and thereby eliminates the need for a dedicated temperature sensor.

WO2016/1050922 and WO2018/019533 disclose more complex methods of detecting depletion of aerosol-forming substrate at the heating element. WO2016/1050922 teaches a system which relies on the ratio, or percentage, of a change in electrical resistance with respect to a predetermined initial electrical resistance. The initial electrical resistance takes into account of parasitic resistance resulting from auxiliary components such as electrical contacts and connections, as well as the electrical resistance of the heating element prior to heating. This results in a more accurate and responsive detection of substrate depletion. WO2018/019533 discloses a system that does not take into account of the initial heating resistance. Rather, it measures the absolute increase in electrical resistance during heating, and is configured to shut down when the increase in electrical resistance exceeds a predetermined threshold. This allow the same detection mechanism to be applied over a wide range of heating elements and aerosol-generating systems, in robust and reliable manner.

However, all of these techniques for detecting the depletion of aerosol-forming substrate require raising the heater temperature substantially in order to detect a change in the resulting electrical resistance, or they can be slow.

SUMMARY

According to an aspect of the present invention there is provided an electrically operated aerosol-generating system comprising: a heating element for heating an aerosol-forming substrate; a power supply for supplying power to the heating element; a temperature sensor for sensing a temperature at the heating element; and electric circuitry in communication with the heating element, the sensor and the power supply, the electric circuitry comprising a memory and being configured to: regulate the supply of power to the heating element based on the measured temperature from the temperature sensor; determine an adverse condition when i) a rate of change of power supplied to the heating element required to reach or maintain a predetermined temperature or ii) a reduction in power supplied to the heating element required to reach or maintain a predetermined temperature over successive heating cycles, falls outside a predefined range, said predefined range being stored in the memory; and control power supplied to the heating element based on whether there is an adverse condition or provide an indication when there is an adverse condition.

BRIEF DESCRIPTION OF THE DRAWINGS

Features described in relation to one aspect may equally be applied to other aspects of the invention.

Embodiments of the invention will now be described, by way of example only, with reference to the accompanying drawings, in which.

DETAILED DESCRIPTION

Figure 1A:
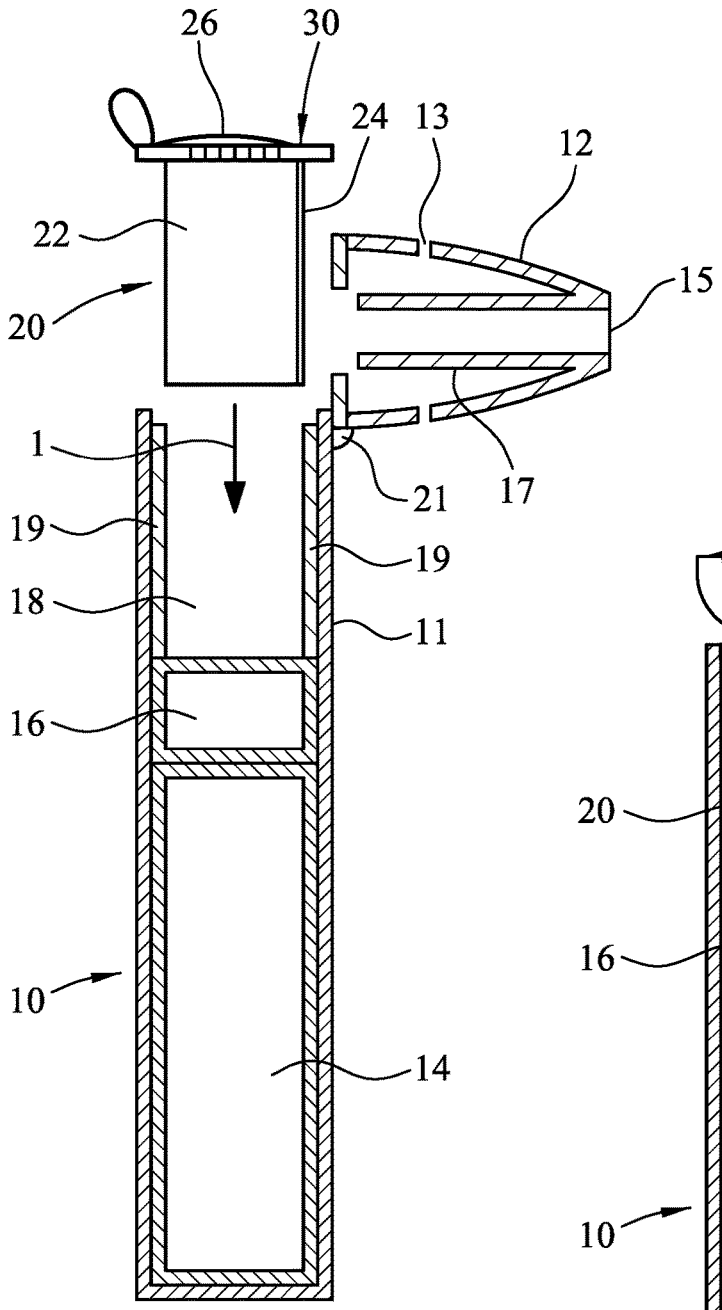
FIGS. 1*a*, 1*b*, 1*c* and 1*d* are schematic illustrations of a system in accordance with an embodiment of the invention.

As used herein, an 'electrically operated aerosol-generating system' means a system that generates an aerosol from one or more aerosol-forming substrates. The aerosol-forming substrate may be contained in a cartridge. An advantage of providing a cartridge is that the aerosol-forming substrate is protected from the ambient environment. Moreover, a high level of hygiene can be maintained. The system may comprise a device for heating the one or more aerosol-forming substrates. An electrical aerosol-generating system may include additional components, such as a charging unit for recharging an on-board electric power supply in an electrically operated aerosol-generating device. The aerosol-generating system may be a system configured to generate an aerosol for user inhalation, such as an inhaler, personal vaporiser or an e-cigarette.

As used herein, the term 'aerosol-forming substrate' means a substrate capable of releasing volatile compounds that may form an aerosol. Such volatile compounds may be released by heating the aerosol-forming substrate.

Advantageously, the electric circuitry may determine an adverse condition, such as depletion of the aerosol-forming substrate or system malfunction, by monitoring a supply of power to the heating element. The electric circuitry may be configured to determine depletion of liquid aerosol-forming substrate at the heating element. "Depletion" in this context means either an insufficient amount of aerosol-forming substrate is provided at the heating element, or a complete depletion of aerosol-forming substrate. Either way, this may lead to a "dry" heating element, as opposed to a "wet" heating element that is saturated with liquid aerosol-forming substrate. For example, when the cartridge is empty or nearly empty, insufficient liquid aerosol-forming substrate may be supplied to the heating element. This may mean that the aerosol created does not have the desired properties, for example, aerosol particle size or chemical composition. This may result in a poor experience for the user.

The electric circuitry may, upon detecting the adverse condition, cease the power supply. This is advantageous because the user can then no longer use the aerosol generating system once there is detected drying out of the heating element. This may avoid creation of an aerosol which does not have the desired properties. And therefore this may avoid a poor experience for the user. The electric circuitry may be arranged to deactivate the heating element by blowing an electrical fuse between the heating element and an electric power supply. The electric circuitry may be arranged to deactivate the heating element by switching off a switch between the heating element and an electric power supply. Alternative methods of deactivating the heating element will be apparent to the skilled person.

The electric circuitry may, alternatively or in addition, provide an indication to the user to alert the user of the adverse condition. The indication may be one or more of an audio indication, a visual indication, a mechanical indication such as vibrational, an olfactory indication, or any other indicating means known to the person skilled in the art. Then the user can prepare to replace or refill the cartridge.

Advantageously, the electric circuitry may determine an adverse condition based on monitoring the power supplied to the heating element. In general, the less aerosol-forming substrate is delivered to the heater for vaporisation, the higher the temperature of the heating element will be for a given applied power. Therefore, the power required at the heating element to maintain or reach a target temperature may accordingly be reduced upon depletion of the aerosol-forming substrate. This is because the heating element may be required to heat less aerosol-forming substrate, or in the case of an empty cartridge, no aerosol-forming substrate at all.

The electric circuitry may therefore determine an adverse condition by monitoring a rate of change in power supply to the heating element required to reach or maintain a predetermined temperature. For example, an adverse condition may be determined upon detecting a sudden surge or drop in power supply whilst maintaining a target temperature. Advantageously, this method may enable a more rapid detection of the adverse condition because an adverse condition can be readily determined even before the power supply has reached a predetermined threshold, as disclosed in prior art systems. In addition, this method does not rely on monitoring an absolute increase in power supply, thus it may advantageously allow adverse condition to be determined with greater independence from ambient conditions, as well as allowing for different substrates.

Alternatively or in addition, the electric circuitry may determine the adverse condition by monitoring the reduction in power supply required, or more specifically minimum power supply required, to reach or maintain a predetermined temperature over successive heating cycles. "Heating cycles" in this context means periods of power supply to the heating element. Typically each heating cycle corresponds to a user puff. Due to variations between different heating elements and substrate combinations, the power required for maintaining a constant temperature may vary between different aerosol-generating systems. Therefore, by comparing the minimum power supply in a given heating cycle with that being supplied in the preceding heating cycles in the same aerosol-generating system, the electric circuitry may detect small changes in power consumption. This may advantageously allow the adverse condition to be detected earlier.

Optionally, the electric circuitry is configured to determine an adverse condition only after the temperature at the heating element has risen from an initial temperature to a target temperature. The electric circuitry may be configured to determine an adverse condition only after the heating element has been maintained at the target temperature for a predetermined time. More specifically, the power required to raise the heating element from an initial temperature to the target temperature can vary, in particular dependent on ambient conditions. Therefore, if the determination of an adverse condition is based on power supply during these periods, such determination may be less reliable. In comparison, when the heating element is maintained at the target temperature, a consistent and steady level of power supply may be observed. The power supply may only deviate from a steady value when there is an adverse condition, such as depletion of aerosol-forming substrate at the heating element, or a malfunction in the aerosol-generating system. Thus, the electric circuitry may determine the adverse condition once the temperature of the heating element has reached and is being maintained at the target temperature. Preferably, the electric circuitry may determine the adverse condition once the detected resistance has reached a predetermined value indicative of the target temperature.

The predefined range may be based on a maximum threshold value of a rate of change in power supply. The adverse condition may be determined when the rate of change in power supply exceeds said maximum threshold value. This may advantageously allow for minor fluctuations in the power supply when there is no adverse condition due to changes in ambient conditions.

Alternatively, the predefined range is based on a minimum threshold value of a reduction in the minimum power supplied over successive heating cycles. The adverse condition may be determined when the reduction in the power supplied to the heating element over successive heating cycles increases above the minimum threshold value. This may advantageously allow for minor reduction in the power supply over successive heating cycles before an adverse condition is determined.

As used herein, the term "heating element" means an electrical heating element powered by the on-board electric power supply. The electrical heating element may comprise a single heating element. Alternatively, the heating element may comprise more than one discrete heating element, for example two, or three, or four, or five, or six or more heating elements. The heating element or heating elements may be arranged appropriately so as to most effectively heat the liquid aerosol-forming substrate.

The heating element may be a resistive heating element. The at least one electric heating element preferably comprises an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, Constantan, nickel-, cobalt-, chromium-, aluminium-titanium- zirconium-, hafnium-, niobium-, molybdenum-, tantalum-, tungsten-, tin-, gallium-, manganese- and iron-containing alloys, and super-alloys based on nickel, iron, cobalt, stainless steel, TIMETAL®, iron-aluminium based alloys and iron-manganese-aluminium based alloys. TIMETAL® is a registered trademark of Titanium Metals Corporation. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise KAPTON®, all-polyimide or mica foil. KAPTON® is a registered trademark of E.I. du Pont de Nemours and Company.

The resistive heating element may take the form of a mesh, array or fabric of electrically conductive filaments. The electrically conductive filaments may define interstices between the filaments and the interstices may have a width of between 10 μm and 100 μm. The electrically conductive filaments may form a mesh of size between 160 and 600 Mesh US (+/−10%) (i.e., between 160 and 600 filaments per inch (+/−10%)). The width of the interstices is preferably between 75 μm and 25 μm. The percentage of open area of the mesh, which is the ratio of the area of the interstices to the total area of the mesh is preferably between 25 and 56%. The mesh may be formed using different types of weave or lattice structures. Alternatively, the electrically conductive filaments consist of an array of filaments arranged parallel to one another. The electrically conductive filaments may have a diameter of between 8 μm and 100 μm, preferably between 8 μm and 50 μm, and more preferably between 8 μm and 39 μm. The filaments may have a round cross section or may have a flattened cross-section.

The area of the mesh, array or fabric of electrically conductive filaments may be small, preferably less than or equal to 25 $mm^2$, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10% and 50% of the area of the heater assembly. More preferably, the mesh or array of electrically conductive filaments covers an area of between 15 and 25% of the area of the heater assembly.

The filaments may be formed by etching a sheet material, such as a foil. This may be particularly advantageous when the heater assembly comprises an array of parallel filaments. If the heating element comprises a mesh or fabric of filaments, the filaments may be individually formed and knitted together.

Preferred materials for the electrically conductive filaments are 304, 316, 304L, and 316L stainless steel.

Alternatively to a mesh arrangement, the at least one electric heating element may take the form of a resistive heater coil, or a casing or substrate having different electroconductive portions, or an electrically resistive metallic tube. The heater may be arranged to circumscribe at least a portion of the cartridge when the cartridge is received within a cavity of the aerosol-generating device. The cartridge may incorporate a disposable heating element. Alternatively, one or more heating needles or rods that run through the liquid aerosol-forming substrate may also be suitable. Alternatively, the at least one electric heating element may comprise a flexible sheet of material. Other alternatives include a heating wire or filament, for example a Ni—Cr (Nickel-Chrome), platinum, tungsten or alloy wire, or a heating plate. Optionally, the heating element may be deposited in or on a rigid carrier material.

The at least one heating element may heat the aerosol-forming substrate by means of conduction. The heating element may be at least partially in contact with the substrate. Alternatively, the heat from the heating element may be conducted to the substrate by means of a heat conductive element.

The at least one heating element may transfer heat to the incoming ambient air that is drawn through the electrically operated aerosol generating system during use, which in turn heats the aerosol-forming substrate. The ambient air may be heated before passing through the aerosol-forming substrate. Alternatively, the ambient air may be first drawn through the substrate and then heated.

The resistive heating element may function as a temperature sensor. For example, if the at least one heating element has suitable characteristics of the temperature coefficient of resistance, measuring the electrical resistance of the at least one heating element will allow the temperature of the heating element to be ascertained. The electric circuitry may be arranged to measure the electrical resistance of the at least one heating element by measuring the current through the at least one heating element and the voltage across the at least one heating element and determining the electrical resistance of the at least one heating element from the measured current and voltage. In that case, the electric circuitry may comprise a resistor, having a known resistance, in series with the at least one heating element and the electric circuitry may be arranged to measure the current through the at least one heating element by measuring the voltage across the known-resistance resistor and determining the current through the at least one heating element from the measured voltage and the known resistance. Therefore, it may not be necessary to include a dedicated temperature sensor, which may take up valuable space in the aerosol generating system and may also be costly.

It is emphasized that the electrical resistance, in this embodiment, is used both as a heating element and a sensor.

The aerosol-forming substrate may be in a liquid phase at room temperature. As used herein, the terms "liquid" and "solid" refer to a state of the aerosol-forming substrate at room temperature. The aerosol-forming substrate may be a flowable liquid at room temperature. For a liquid aerosol-forming substrate, certain physical properties, for example the vapour pressure or viscosity of the substrate, are chosen in a way to be suitable for use in the aerosol generating system.

The aerosol-forming substrate may comprise plant-based material. The aerosol-forming substrate may comprise tobacco. The aerosol-forming substrate may comprise a tobacco-containing material containing volatile tobacco flavour compounds, which are released from the aerosol-forming substrate upon heating. The aerosol-forming substrate may alternatively comprise a non-tobacco-containing material. The aerosol-forming substrate may comprise homogenised plant-based material. The aerosol-forming substrate may comprise homogenised tobacco material. The aerosol-forming substrate may comprise at least one aerosol-former. An aerosol-former may be any suitable known compound or mixture of compounds that, in use, facilitates formation of a dense and stable aerosol and that is substantially resistant to thermal degradation at the operating temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as triethylene glycol, 1,3-butanediol and, most preferred, glycerine. The aerosol-forming substrate may comprise other additives and ingredients, such as flavourants.

For the liquid aerosol-forming substrate, certain physical properties, for example the vapour pressure or viscosity of the substrate, are chosen in a way to be suitable for use in the aerosol generating system. The liquid preferably comprises a tobacco-containing material comprising volatile tobacco flavour compounds which are released from the liquid upon heating. Alternatively, or in addition, the liquid may comprise a non-tobacco material. The liquid may include water, ethanol, or other solvents, plant extracts, nicotine solutions, and natural or artificial flavours. Preferably, the liquid further comprises an aerosol former. Examples of suitable aerosol formers are glycerine and propylene glycol.

The aerosol-forming substrate may be contained in a refillable liquid storage portion in the aerosol-generating device, or it may be a disposable cartridge in the aerosol-generating system. Preferably the aerosol-forming substrate is contained a disposable cartridge in the aerosol-generating system. Said cartridge may be replaced after a single session of use, or it may be replaced after a plurality of sessions of use. This may allow the user to replace a depleted cartridge in a safe and efficient manner.

The liquid aerosol-forming substrate may be delivered from the cartridge to the heating element by a mechanical device, for example a manual pump or an electric pump.

Preferably, the electrically operated aerosol generating system further comprises a capillary wick for conveying the liquid aerosol-forming substrate to the heating element. This may reduce the number of moving parts in the aerosol-generating device, and thus it may improve reliability, as well as reducing weight and cost.

Optionally, the capillary wick is arranged to be in contact with liquid in the cartridge. Optionally, the capillary wick extends into the cartridge. In that case, in use, liquid may be transferred from the cartridge to the heating element by capillary action in the capillary wick. In one embodiment, the capillary wick may comprise a first end and a second end, the first end may extend into the cartridge for contact with liquid therein and the heating element may be arranged to heat liquid in the second end. When the heating element is activated, the liquid at the second end of the capillary wick may be vaporized by the at least one heating element to form the supersaturated vapour. The supersaturated vapour may be mixed with and carried in an air flow. During the flow, the vapour condenses to form the aerosol and the aerosol may be carried towards the mouth of a user. The liquid aerosol-forming substrate may have physical properties, including viscosity and surface tension, which allow the liquid to be transported through the capillary wick by capillary action.

The capillary wick may have a fibrous or spongy structure. The capillary wick preferably comprises a bundle of capillaries. For example, the capillary wick may comprise a plurality of fibres or threads or other fine bore tubes. The fibres or threads may be generally aligned in the longitudinal direction of the aerosol generating system. Alternatively, the capillary wick may comprise sponge-like or foam-like material formed into a rod shape. The rod shape may extend along the longitudinal direction of the aerosol generating system. The structure of the wick may form a plurality of small bores or tubes, through which the liquid can be transported by capillary action. The capillary wick may comprise any suitable material or combination of materials. Examples of suitable materials are capillary materials, for example a sponge or foam material, ceramic- or graphite-based materials in the form of fibres or sintered powders, foamed metal or plastics material, a fibrous material, for example made of spinned or extruded fibres, such as cellulose acetate, polyester, or bonded polyolefin, polyethylene, terylene or polypropylene fibres, nylon fibres or ceramic. The capillary wick may have any suitable capillarity and porosity so as to be used with different liquid physical properties. The liquid may have physical properties, including but not limited to viscosity, surface tension, density, thermal conductivity, boiling point and vapour pressure, which allow the liquid to be transported through the capillary device by capillary action. The capillary properties of the wick, combined with the properties of the liquid aerosol-forming substrate, may ensure that, during normal use when there is plenty of aerosol-forming substrate, the wick is always wet in the heating area.

The capillary wick and the heating element, and optionally the cartridge, may be removable from the aerosol generating system as a single component.

The system may comprise an aerosol-generating device and a removable cartridge, wherein the power supply and the electric circuitry are provided in the device and the heating element may be provided in the removable cartridge, and wherein the cartridge comprises a liquid aerosol-forming substrate. The heating element may be configured to connect to the power supply and the electric circuitry by means of suitable connectors. The heating element may be a disposable heating element. The heating element may be replaceable with the removable cartridge.

Optionally, cartridges having different properties can be used with the device. For example, two different cartridges having different sized heating elements may be provided with the device. For example, a heating element with a higher power rating may be used to deliver more aerosol. A cartridge with a higher capacity may be used to reduce the frequency of cartridge replacement.

Preferably, the aerosol generating device comprises a housing. Preferably, the housing is elongate. If the aerosol generating device includes a capillary wick, the longitudinal axis of the capillary wick and the longitudinal axis of the housing may be substantially parallel.

The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. Preferably, the material is light and non-brittle.

Optionally, the aerosol-generating device comprises a user input device. The user input device may comprise at least one of a push-button, a scroll-wheel, a touch-button, a touch-screen, and a microphone. The user input device may allow a user to control one or more aspects of the operation of the aerosol-generating device. The user input device may allow a user to activate a supply of electrical power to the heater, to deactivate a supply of electrical power to the heater, or both.

Optionally, the electric circuitry comprises a microprocessor and more preferably a programmable microprocessor. The system may comprise a data input port or a wireless receiver to allow software to be uploaded onto the microprocessor. The electric circuitry may comprise additional electrical components.

Optionally, the aerosol-generating system further comprises a puff detector for detecting when a user is puffing on the system. The puff detector may be in communication with the electric circuitry. The electric circuitry may be configured to supply power from the power supply to the heating element when a puff is detected by the puff detector, so that each puff corresponds to a heating cycle. The electric circuitry may be configured to determine if there is an adverse condition during each heating cycle. The puff detector may form the user input device at the aerosol-generating device. That is, the user may not need to depress a mechanical button in order to start a heating cycle.

The aerosol-generating device may further comprise a mouthpiece. The mouthpiece may be configured for engagement with the housing of the aerosol-generating device or the cartridge. Optionally, the mouthpiece is configured for engagement with the aerosol-generating device, the combination of the aerosol-generating device and the mouthpiece may simulate the shape and dimensions of a combustible smoking article, such as a cigarette, a cigar, or a cigarillo. Advantageously, in such embodiments the combination of the aerosol-generating device and the mouthpiece may simulate the shape and dimensions of a cigarette.

The power supply may be any suitable power supply, for example a DC voltage source such as a battery. The power supply may be a Lithium-ion battery, a Nickel-metal hydride battery, a Nickel cadmium battery, or a Lithium based battery, for example a Lithium-Cobalt, a Lithium-Iron-Phosphate, Lithium Titanate or a Lithium-Polymer battery.

Optionally, the power supply may include a rechargeable lithium ion battery. The electrical power supply may comprise another form of charge storage device such as a capacitor. The electrical power supply may require recharging. The electrical power supply may have a capacity that allows for the storage of enough energy for one or more uses of the aerosol-generating device. For example, the electrical power supply may have sufficient capacity to allow for the continuous generation of aerosol for a period of around six minutes, corresponding to the typical time taken to smoke a conventional cigarette, or for a period that is a multiple of six minutes. In another example, the electrical power supply may have sufficient capacity to allow for a predetermined number of puffs or discrete activations.

The electric circuitry may be configured to commence a supply of electrical power from the electrical power supply to the heater at the start of a heating cycle. The electric circuitry may be configured to terminate a supply of electrical power from the electrical power supply to the heater at the end of a heating cycle.

The electric circuitry may be configured to provide a continuous supply of electrical power from the electrical power supply to the heater.

The electric circuitry may be configured to provide an intermittent supply of electrical power from the electrical power supply to the heater. The electric circuitry may be configured to provide a pulsed supply of electrical power from the electrical power supply to the heater.

Advantageously, a pulsed supply of electrical power to the heater may facilitate control of the total output from the heater during a time period. Advantageously, controlling a total output from the heater during a time period may facilitate control of temperature.

The electric circuitry may be configured to vary the supply of electrical power from the electrical power supply to the heater. The electric circuitry may be configured to vary a duty cycle of the pulsed supply of electrical power. The electric circuitry may be configured to vary at least one of a pulse width and a period of the duty cycle.

Optionally, the aerosol generating system is portable. The aerosol generating system may be a smoking system and may have a size comparable to a conventional cigar or cigarette. The smoking system may have a total length between approximately 30 mm and approximately 150 mm. The smoking system may have an external diameter between approximately 5 mm and approximately 30 mm.

According to a second aspect of the invention, there is provided a method of controlling the supply of power to a heating element in an electrically operated aerosol-generating system, comprising: measuring a temperature at a heating element; regulating the supply of power to the heating element based on the measured temperature; determining an adverse condition when i) a rate of change in power supply to the heating element required to reach or maintain a predetermined temperature or ii) a reduction in power supply required to reach or maintain a predetermined temperature over successive heating cycles falls outside a predefined range, said predefined range being stored in the memory; and controlling power supplied to the heating element based on whether there is an adverse condition, or providing an indication when there is an adverse condition.

According to a third aspect of the invention, there is provided a computer program product directly loadable into the internal memory of a microprocessor comprising software code portions for performing the steps of the second aspect when said product is run on a microprocessor in an electrically operated aerosol-generating system, the system comprising a heating element for heating an aerosol-forming substrate, a sensor for sensing a temperature of the heating element and a power supply for supplying power to the heating element, the microprocessor connected to the heating element, sensor and the power supply.

For the avoidance of doubt, features described above in relation to one aspect of the invention may also be applicable to other aspects of the invention.

FIGS. 1*a* to 1*d* are schematic illustrations of an electrically heated aerosol-generating system in accordance with an embodiment of the invention. The aerosol-generating system comprises an aerosol-generating device 10 and a cartridge 20.

The cartridge 20 contains an aerosol-forming substrate in a cartridge housing 24 and is configured to be received in a cavity 18 within the device. The cartridge 20 is a disposable cartridge. A user may replace the cartridge 20 once the aerosol-forming substrate in the cartridge is depleted. The cartridge comprises a removable seal 26 for providing a hermetic seal to the cartridge housing 24. This allows the aerosol-forming substrate as contained in the cartridge housing 24 be shielded from the environment prior to its first use. FIG. 1 a shows the cartridge 20 just prior to insertion into the device, with the arrow 1 in FIG. 1*a* indicating the direction of insertion of the cartridge.

The aerosol-generating device 10 is portable and has a size comparable to a conventional cigar or cigarette. The device 10 comprises a main body 11 and a mouthpiece portion 12. The main body 11 contains a battery 14, such as a lithium iron phosphate battery, electric circuitry 16 and a cavity 18. The electric circuitry 16 comprises a programmable microprocessor. The mouthpiece portion 12 is connected to the main body 11 by a hinged connection 21 and can move between an open position as shown in FIG. 1*a* and a closed position as shown in FIG. 1*d*. The mouthpiece portion 12 is placed in the open position to allow for insertion and removal of cartridges 20 and is placed in the closed position when the system is to be used to generate aerosol. The mouthpiece portion comprises a plurality of air inlets 13 and an outlet 15. In use, a user sucks or puffs on the outlet to draw air from the air inlets 13, through the mouthpiece portion to the outlet 15, and thereafter into the mouth or lungs of the user. Internal baffles 17 are provided to force the air flowing through the mouthpiece portion 12 past the cartridge.

The cavity 18 has a circular cross-section and is sized to receive a housing 24 of the cartridge 20. Electrical connectors 19 are provided at the sides of the cavity 18 to provide an electrical connection between the control electronics 16 and battery 14 and corresponding electrical contacts on the cartridge 20.

Figure 1B:
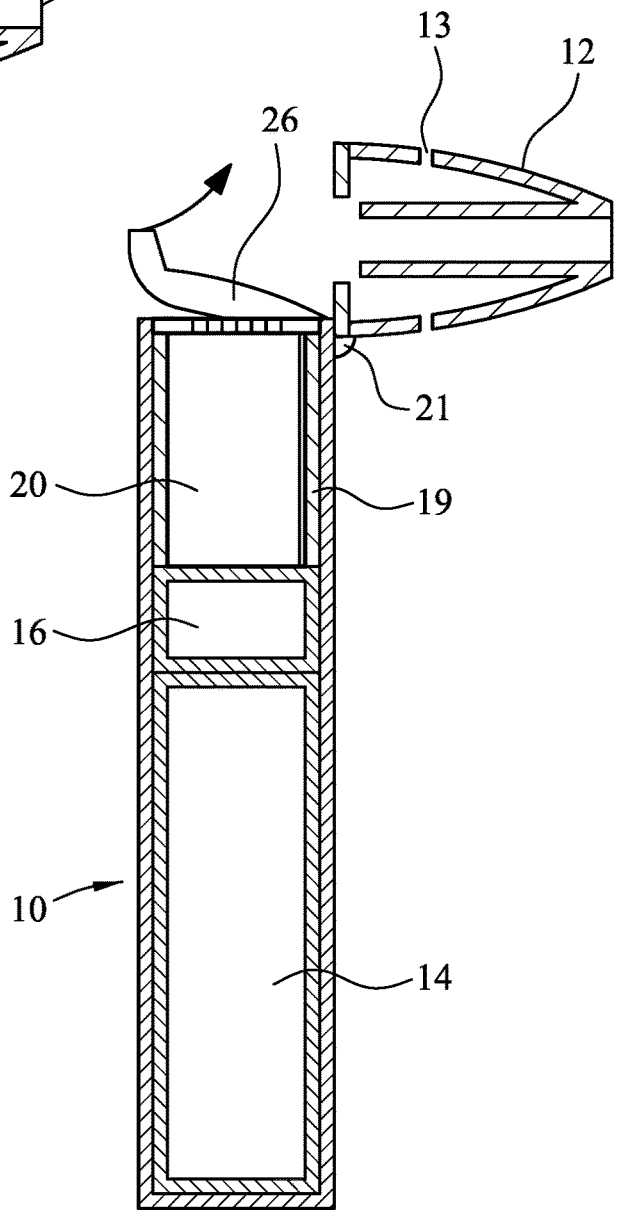

FIG. 1*b* shows the system of FIG. 1*a* with the cartridge inserted into the cavity 18, and the removable seal 26 being removed. In this position, the electrical connectors rest against the electrical contacts on the cartridge.

Figure 1C:
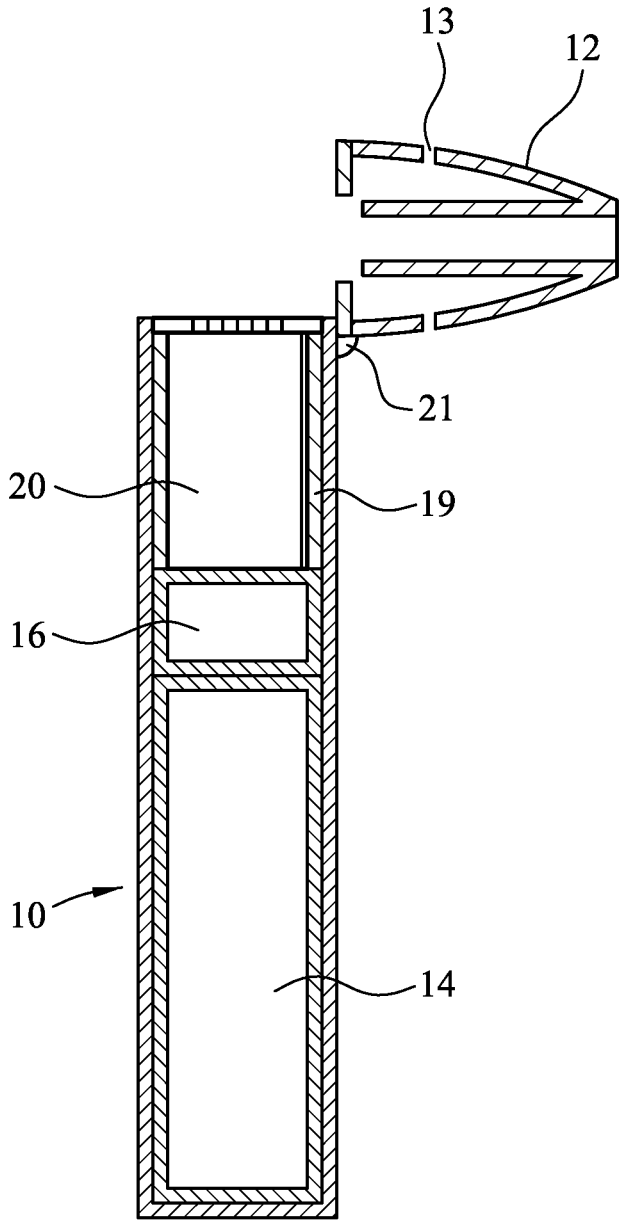
Figure 1D:
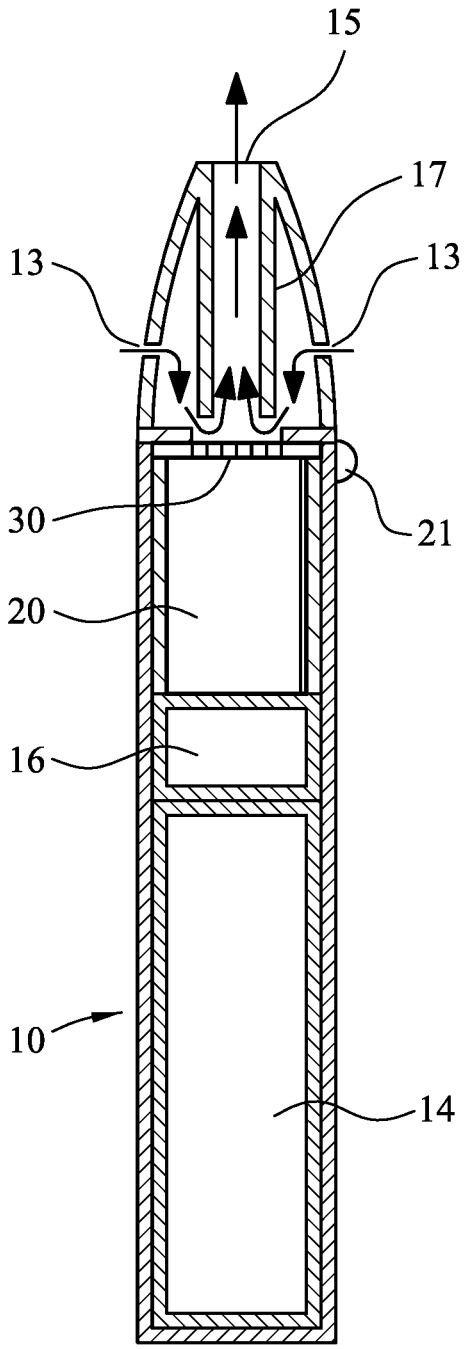

FIG. 1*c* shows the system of FIG. 1*b* with the releasable seal 26 removed and the mouthpiece portion 12 being moved to a closed position.

FIG. 1*d* shows the system of FIG. 1*c* with the mouthpiece portion 12 in the closed position. The mouthpiece portion 12 is retained in the closed position by a clasp mechanism. The mouthpiece portion 12 in a closed position retains the cartridge in electrical contact with the electrical connectors 19 so that a good electrical connection is maintained in use, whatever the orientation of the system is.

Figure 2:
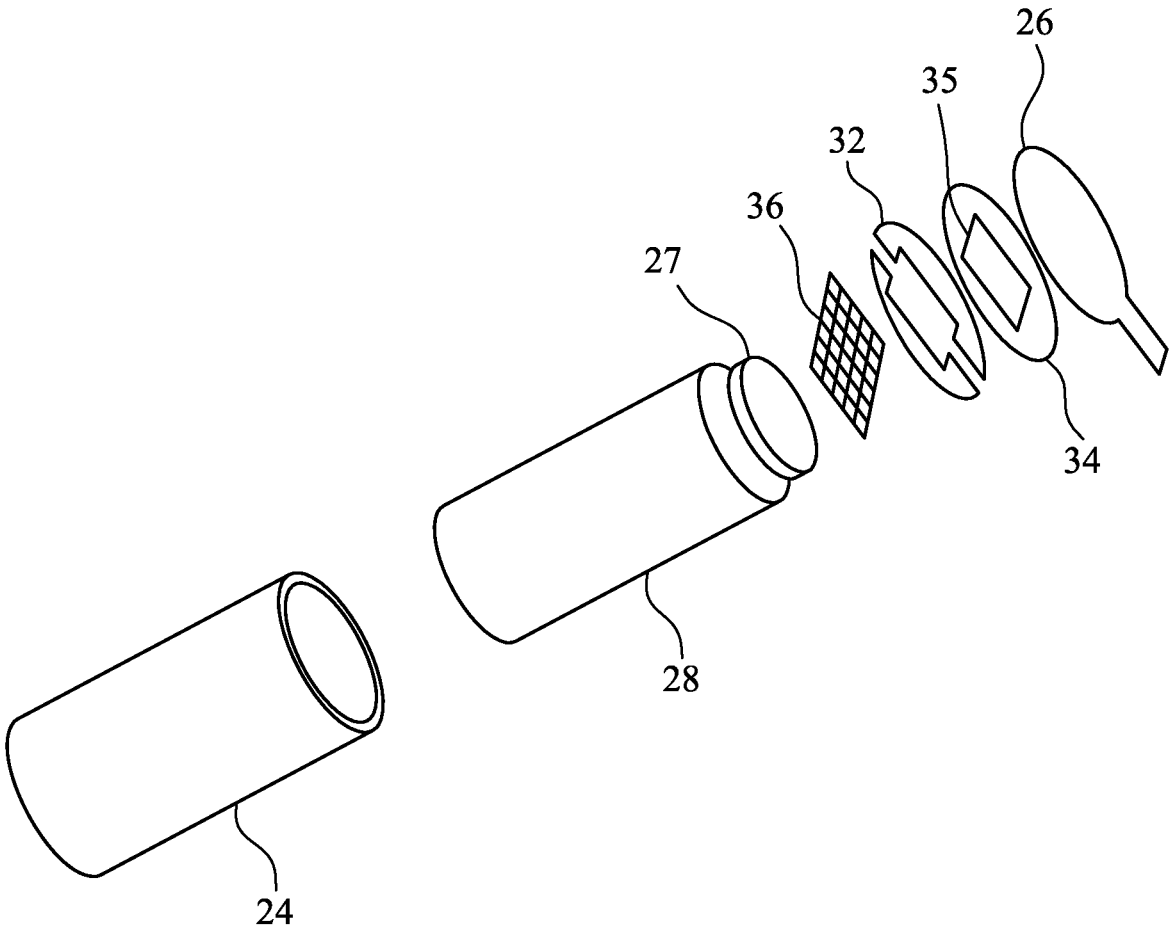
FIG. 2 is an exploded view of a cartridge for use in a system as shown in FIGS. 1*a* to 1*d;*

FIG. 2 is an exploded view of the cartridge 20. The cartridge housing 24 that has a size and shape selected to be received into the cavity 18. The housing contains capillary material 27, 28 that is soaked in a liquid aerosol-forming substrate. In this example the aerosol-forming substrate comprises 39% by weight glycerine, 39% by weight propylene glycol, 20% by weight water and flavourings, and 2% by weight nicotine. A capillary material is a material that actively conveys liquid from one end to another, based on relative differences in liquid concentration. The capillary material may be made from any suitable material. In this example the capillary material is formed from polyester.

The cartridge housing 24 has an open end to which a heater assembly 30 is fixed. The heater assembly 30 comprises a substrate 34 having an aperture 35 formed in it, a pair of electrical contacts 32 fixed to the substrate and separated from each other by a gap 33, and a plurality of electrically conductive heater filaments 36 spanning the aperture and fixed to the electrical contacts on opposite sides of the aperture 35.

The heater assembly 30 is covered by the releasable seal 26. The releasable seal 26 comprises a liquid impermeable plastic sheet that is glued to the heater assembly 30 but which can be easily peeled off. A tab is provided on the side of the releasable seal 26 to allow a user to grasp the releasable seal 26 when peeling it off. It will now be apparent to one of ordinary skill in the art that although gluing is described as the method to a secure the impermeable plastic sheet to the heater assembly, other methods familiar to those in the art may also be used including heat sealing or ultrasonic welding, so long as the cover may easily be removed by a consumer.

There are two separate capillary materials 27, 28 in the cartridge of FIG. 2. A disc of a first capillary material 27 is provided to contact the heater element 36, 32 in use. A larger body of a second capillary material 28 is provided on an opposite side of the first capillary material 27 to the heater assembly. Both the first capillary material and the second capillary material retain liquid aerosol-forming substrate. The first capillary material 27, which contacts the heater element, has a higher thermal decomposition temperature (at least 160° C. or higher such as approximately 250° C.) than the second capillary material 28. The first capillary material 27 effectively acts as a spacer separating the heater element 36, 32 from the second capillary material 28 so that the second capillary material is not exposed to temperatures above its thermal decomposition temperature. The thermal gradient across the first capillary material is such that the second capillary material is exposed to temperatures below its thermal decomposition temperature. The second capillary material 28 may be chosen to have superior wicking performance to the first capillary material 27, may retain more liquid per unit volume than the first capillary material and may be less expensive than the first capillary material. In this example the first capillary material is a heat resistant material, such as a fiberglass or fiberglass containing material and the second capillary material is a polymer such as suitable capillary material. Exemplary suitable capillary materials include the capillary materials discussed herein and in alternative embodiments may include high density polyethylene (HDPE), or polyethylene terephthalate (PET).

Figure 3:
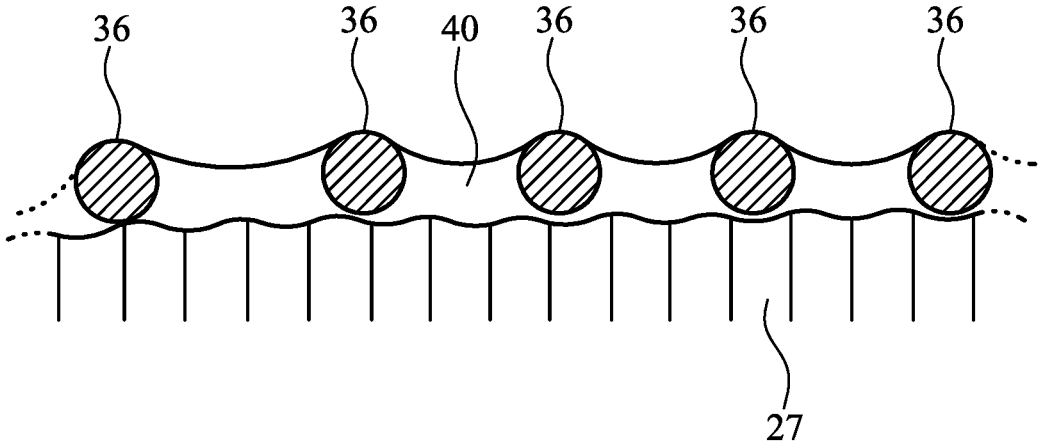
FIG. 3 is a detailed view of heater filaments of a heater assembly in the cartridge as shown in FIG. 2, showing a meniscus of liquid aerosol-forming substrate between the filaments.

The capillary material 27, 28 is advantageously oriented in the housing 24 to convey liquid to the heater assembly 30. When the cartridge is assembled, the heater filaments 36, may be in contact with the capillary material 27 and so aerosol-forming substrate can be conveyed directly to the mesh heater. FIG. 3 is a detailed view of the filaments 36 of the heater assembly 30, showing a meniscus 40 of liquid aerosol-forming substrate between the heater filaments 36. It can be seen that aerosol-forming substrate contacts most of the surface of each filament 36 so that most of the heat generated by the heater assembly 30 passes directly into the aerosol-forming substrate.

So, in normal operation, liquid aerosol-forming substrate contacts a large portion of the surface of the heater filaments 36. However, when most of the liquid substrate in the cartridge has been used, less liquid aerosol-forming substrate will be delivered to the heater filaments 36. With less liquid to vaporize, less energy is taken up by the enthalpy of vaporization and more of the energy supplied to the heater filaments 36 is directed to raising the temperature of the heater filaments. Likewise, the energy required for maintaining a target temperature also decreases as the heater filaments 36 dry out. The heater filaments 36 may dry out because the aerosol-forming substrate in the cartridge has been depleted. Alternatively but less likely, the heater filaments 36 may dry out because the user is taking exceptionally long or frequent puffs and the liquid cannot be delivered to the heater filaments 36 as fast as it is being vaporized.

In use, the heater assembly 30 operates by resistive heating. Current is passed through the filaments 36 under the control of control electronics 16, to heat the filaments to within a desired temperature range. The mesh or array of filaments has a significantly higher electrical resistance than the electrical contacts 32 and electrical connectors 19 so that the high temperatures are localised to the filaments. This minimises heat loss to other parts of the aerosol-generating device 10. In this example, the system is configured to generate heat by providing electrical current to the heater assembly 30 in response to a user puff.

The system includes a puff sensor configured to detect when a user is drawing air through the mouthpiece portion. The puff sensor (not illustrated) is connected to the control electronics 16 and the control electronics 16 are configured to supply current to the heater assembly 30 only when it is determined that the user is puffing on the device. Any suitable air flow sensor may be used as a puff sensor, such as a microphone or pressure sensor.

In order to detect an increase in temperature, the electric circuitry 16 is configured to measure the electrical resistance of the heater filaments. The heater filaments 36 in this example are formed from stainless steel, and so have a positive temperature coefficient of resistance. In addition, because heat is generated in short bursts using high current pulses in such puff actuated system, stainless steel filaments having a relatively high specific heat capacity is ideal.

As the temperature of the heater filaments 36 rises so does their electrical resistance. It will be appreciated that in other embodiments the heater filaments 36 may be formed from a material having a negative coefficient of resistance, for which, as the temperature of the heater filaments rises their electrical resistance decreases.

Figure 4:
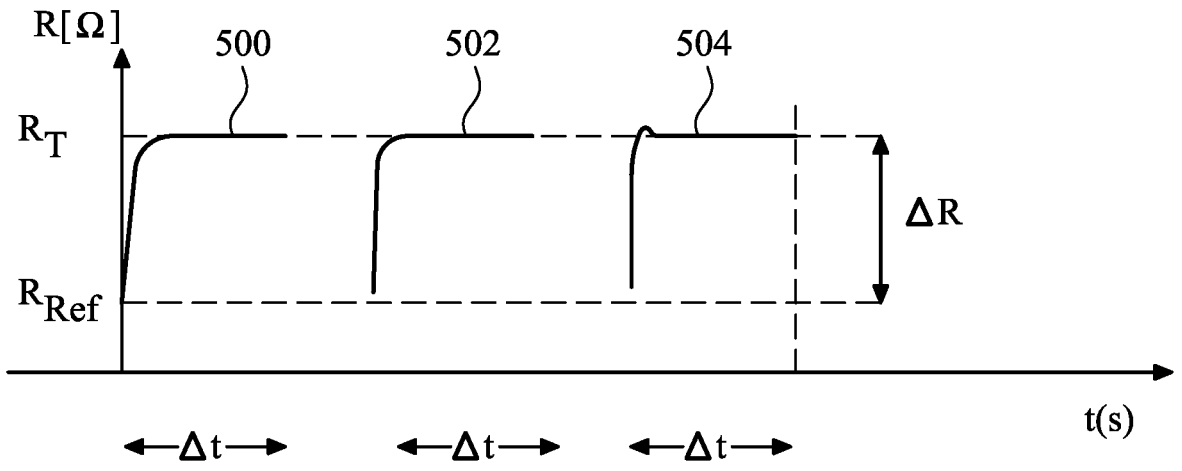
FIG. 4 is a plot showing the change in electrical resistance of the heater assembly during multiple puffs.

FIG. 4 is plot showing the change in resistance of the heater as detected during a plurality of user puffs. Each of the puffs lasts for a puff duration Δt. The x-axis represents time and the y-axis represents detected electrical resistance at the heater assembly 30. In FIG. 4, the change in electrical resistance is detected in three different heating cycles, each corresponding to a user puff: 1) during a heating cycle 500 where the heater filaments 36 are saturated with aerosol-forming substrate, e.g. under normal operation; 2) during a heating cycle 502 where an insufficient supply of aerosol-forming substrate is provided to the heater filaments 36, e.g. the liquid substrate is not fully replenished at the heater filaments 36; and 3) during a heating cycle 504 where the heater filaments 36 are depleted of aerosol-forming substrate. The electric circuitry may be configured to determine that both heating cycles 502 and 504 include adverse conditions. Alternatively, the electric circuitry may be configured to determine that only heating cycle 504 is an adverse condition.

The heater assembly 30 has an initial resistance $R_{Ref}$. Said initial resistance $R_{Ref}$ is an intrinsic property of the heater assembly 30. It indicates a reference resistance of the heater assembly 30 at room temperature. The initial resistance $R_{Ref}$ is a combination of a parasitic resistance $R_P$ and the resistance of the heater filaments $R_0$ at room temperature. Therefore, $R_0$ can be determined from $R_0=R_{Ref}-R_P$. More specifically, the parasitic resistance $R_P$ is resistance resulting from the electrical contacts 32 and electrical connectors 19 and the contact between them. $R_0$ is the resistance of the heater filaments 36 at an ambient temperature.

The initial resistance $R_{Ref}$ of a new cartridge 20 is measured at least once before any heating is applied. A detection system is used to determine when a new cartridge 20 is inserted. In some cases $R_{Ref}$ may be measured only once for each cartridge. $R_{Ref}$ may be measured each time the system is switched on. In this embodiment, the electric circuitry is configured to periodically take updated measurements of $R_{Ref}$ after predetermined time periods in which no power has been supplied to the heater filaments 36. The predetermined time periods each last for 3 minutes, but any suitable time required for the heater filaments 36 to cool from their operating temperature back to the ambient temperature may be chosen. Such periodic updates to $R_{Ref}$ recalibrates the electric circuitry to compensate for changes in ambient temperature, as well as the condition of the heater filaments 36.

As power is applied to the heater assembly 30 during a user puff, the temperature of the heater filaments 36 rises from the ambient temperature. This causes the electrical resistance R of the heater filaments 36 to rise. However, the parasitic resistance $R_P$ is assumed to stay constant. This is because $R_P$ is attributable to non-heated components, such as the electrical contacts 32 and electrical connectors 19. In addition, the value of $R_P$ is assumed to be the same for all cartridges and will not be affected by changing over to a different cartridge. The parasitic resistance $R_P$ value, for a particular aerosol-generating device 20, is stored in the memory of the electric circuitry.

The resistance of the heater filaments 36 is linearly related to its temperature. Therefore the temperature of the heater assembly can be regulated by controlling the resistance R at a target resistance $R_T$ based on a factor K, where $R_T=(R_0)\cdot K$, or $R_T=(R_{Ref}-R_P)\cdot K$. K may be a predefined value and be stored in a memory of the electric circuitry.

FIG. 4 illustrates the change in electrical resistance ΔR across a heater assembly 30 as it is being heated up from an ambient temperature to, and subsequently as it is being maintained at a target heater temperature during user puffs. Each of the heating cycles 500, 502, 504 corresponds to a user puff and has a duration of Δt. In the illustrated example, each heating cycle begins with a heating assembly 30 at ambient temperature and the resistance of the heating assembly, $R_{Ref}$. However this may not always be case, because the heater assembly 30 may not completely cool between puffs. Therefore the electrical resistance R, in actual use, may start at a level that is higher than $R_{Ref}$. But the temperature, or the corresponding electrical resistance R, of the heater assembly 30 at the beginning of the heating cycle is not significant. This is because the electric circuitry is configured to determine an adverse condition once the heater assembly 30 has reached its target temperature.

The heater assembly 30 in heating cycle 500 is saturated with liquid aerosol-forming substrate. This is representative of a normal operating condition. In this example, the temperature of the heating assembly 30 is configured to be regulated by a factor K of 1.2. At the start of the heating cycle, the electric circuitry supplies electrical energy to the heater assembly 30 whilst measuring the heater resistance R. This period of heating may be referred to as a heating-up phase. During the heating-up phase, the electric circuitry may continue supplying power to the heater assembly 30 until the measured heater resistance R equals to $R_T$, which in this case is 1.2 $R_0$.

Once the RT is reached, the electric circuitry may continue to supply power, either at a reduced level or in an intermittent manner, to regulate the heater resistance R at the target heater resistance $R_T$. This results in a constant heater temperature. This period of temperature maintenance may be referred to as a maintenance phase. During such maintenance phase, the heater resistance R is regulated to remain at a constant value.

The factor K may be factory set as a default value. The factor K correlates to a default target temperature of the heater filaments 36. In addition, a user may adjust the factor K from its default value using an user input device, for example a set of mechanical buttons or a scroll wheel. This allows the users to adjust the target heater temperature according to their own preference.

If the heater assembly receives a reduced amount of liquid substrate, the rate of temperature rise, dT/dt, at the heater filaments 36 increases during the heating up phase. Accordingly, the rate of increase in resistance, dR/dt, at the heater filaments 36 during this period also increases. Such situation may arise for example, when the liquid substrate cannot be fully replenished at the heater filaments 36. This is illustrated in heating cycle 502 of FIG. 4. The heater filaments 36 have an insufficient liquid substrate supply. During the heating up phase of the heating cycle 502, the rate of increase in electrical resistance dR/dt is steeper than that during the heating cycle 500. The rate of increase in electrical resistance dR/dt rises even further when the heater filaments 36 are completely depleted of liquid substrate, as shown in the heating cycle 504 of FIG. 4. In some cases, due to the absence of liquid substrate, the heater temperature rises so rapidly that the heater assembly 30 cannot dissipate the heat fast enough, causing the electrical resistance to rise above RT. This can be seen in heating cycle 504.

In one embodiment the electric circuitry is configured to cease power supply to the heater assembly upon detecting the rate of increase in electrical resistance dR/dt exceeds an upper threshold. For example, such upper threshold may be a rate of increase in electrical resistance that is only exhibited when the cartridge is empty. Furthermore, a visual warning, such as a flashing LED signal, may be given to the user to prompt a cartridge replacement.

Figure 5:
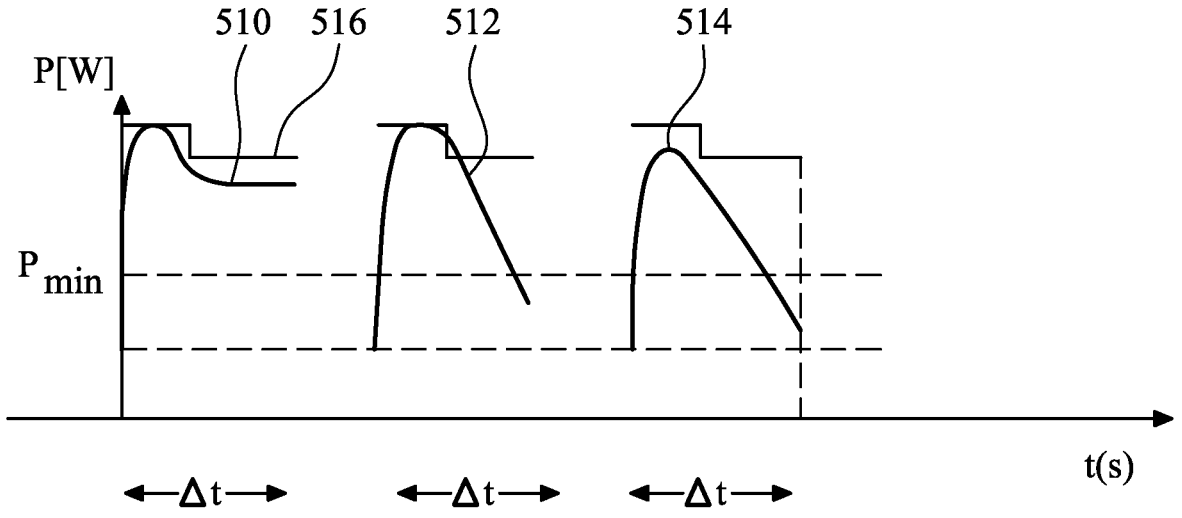
FIG. 5 is a plot showing the change in power supply to the heater assembly corresponding to the multiple puffs as shown in FIG. 4.

The power supply to the heater assembly 30 may also be used for determining the depletion of aerosol-forming substrate at the heater filaments 36. This is illustrated by heating cycles 510, 512 and 514 shown in FIG. 5, each showing a power supplied during heating cycles 500, 502 and 504 in FIG. 4. The power supplied is determined based on a change in power, ΔW, within a specific time interval. For example, the power supplied is detected every 100 ms.

Heating cycle 510 shows the change in power supplied during a puff where the heater filament 36 is saturated with liquid substrate. It can be seen that the power supply gradually rises to its highest level during the heating up period. This allows the heater assembly 30 heat up quickly. In some cases the power supply may start at its highest level at the beginning of the heating cycle, which allows even faster heating.

The power supply then reduces and stabilises at a lower level during the maintenance phase. The electric circuitry sets a predetermined power supply limit 516 for limiting the maximum power supply to the heater assembly 30. The power supply limit 516 forms a passive safety mechanism to prevent overheating. In the illustrated example, the power supply limit 516 is variable, with a high limit during the heating up phase compared to the maintenance phase respectively.

Heating cycle 512 shows the change in power supply during a puff where insufficient liquid substrate is being supplied to the heater filament. The power supply during the heating up phase in heating cycle 512 is similar to the power supplied when the heater filaments 36 saturated with liquid substrate as shown in heating cycle 510. However, as the influx of liquid substrate fails to replenish the vaporised substrate at the heater filaments 36, the power required for maintaining the heater assembly 30 at its target temperature gradually reduces towards the end of the user puff.

Heating cycle 514 shows the change in power supply during a puff where liquid substrate is depleted at the heater filament. Due to a lack of liquid substrate, the power as supplied to heater assembly 30 during the heating up phase is significantly lower than that in heating cycles 510 and 512. Similar to heating cycle 512, as the liquid substrate is depleted at the heater filaments 36, the power required for maintaining its target temperature reduces rapidly towards the end of the user puff.

The electric circuitry is configured to detect insufficient liquid substrate at the heater filaments 36 during the maintenance phase based on a reduction in the power supplied. More specifically, once the heater assembly 30 has reached the target resistance representative of the target temperature, the power supply gradually reduces until it reaches a predetermined minimum power threshold, $P_{min}$. The electric circuitry then determines an insufficient liquid substrate level at the heater filaments 36, as shown in heating cycle 512, or as shown in heating cycle 514 when the cartridge is empty.

In contrast, heater filaments that are saturated with liquid substrate require more power than the minimum power threshold, $P_{min}$ to maintain its electrical resistance R at the target resistance $R_T$. Thus a power consumption beneath the predetermined minimum power threshold, $P_{min}$, can only be achieved if there is a lack of liquid substrate at the heater filaments 36.

In this embodiment, the electric circuitry is configured to cease power supply immediately if it detects the power supply has dropped below the minimum power threshold, $P_{min}$.

Alternatively, upon detecting insufficient liquid substrate at the heater filaments 36, the electric circuitry does not cease power supply immediately. Instead, the electric circuitry may continue power supply for one or more further puffs. For example, the electric circuitry may continue power supply for two further puffs. This allows the electric circuitry to continue monitoring power supply in successive puffs, to confirm substrate depletion at the heater filaments 36.

Figure 6:
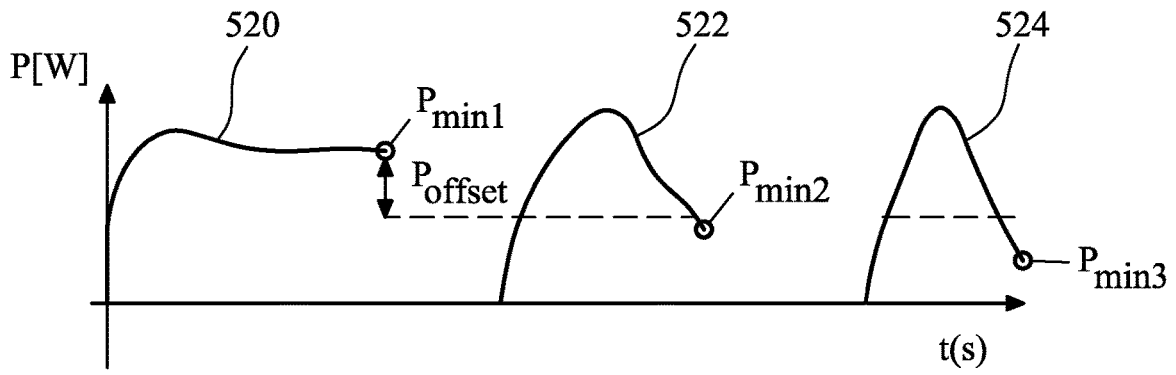
FIG. 6 is a plot showing the difference in minimum power supply to the heater assembly corresponding to the multiple puffs as shown in FIG. 4 and FIG. 5.

In another embodiment, the depletion of liquid substrate may be determined by monitoring the reduction in a minimum power supply over successive puffs. More specifically, the electric circuitry may compare the minimum power supply $P_{min}$ as recorded in each of the successive puffs. The electric circuitry may then determine an adverse condition when the difference between the minimum power supply $P_{min}$ over successive cycles exceeds an offset threshold $\Delta P_{offset}$. This is illustrated in FIG. 6, which shows the power supply over three successive heating cycles corresponding to three successive user puffs: 1) during a heating cycle 520 in which the heater filaments are saturated with aerosol-forming substrate, which are normal operating conditions; 2) during a heating cycle 522 in which an insufficient supply of aerosol-forming substrate is provided to the heater filaments; and 3) during a heating cycle 524 in which the heater filaments are depleted of aerosol-forming substrate.

Under normal operating conditions when the heater filaments 36 are saturated with liquid aerosol-forming substrate, the minimum power supply during a puff is $P_{min1}$. If all of the successive puffs within a particular session take place under normal operation, the minimum power supply $P_{min}$ recorded during each of the heating cycles will be approximately $P_{min1}$. That is, under normal operating condition the recorded minimum power supply $P_{min}$ from puff to puff is substantially consistent. The offset in the minimum power supply $P_{min}$ is expected to be very small. In particular, when the heater filaments 36 are saturated with liquid substrate the offset in minimum power supply will not exceed a predetermined threshold $\Delta P_{offset}$.

However, the quantity of available liquid aerosol-forming substrate in the cartridge reduces with each successive puffs. When the cartridge is nearly empty, the liquid aerosol-forming substrate starts to deplete at the heater filaments 36. In this case, the minimum power supply $P_{min}$ recorded during a puff reduces with each successive puffs. For example, $P_{min2}$ represents the minimum power supply recorded during a second heating cycle 522, which is lower than $P_{min1}$ as recorded during a preceding heating cycle. In this case, the difference between $P_{min2}$ and $P_{min1}$ exceeds the predetermined $\Delta P_{offset}$ threshold, so $P_{min2}<(P_{min1}-\Delta P_{offset})$ The electric circuitry therefore determines that there is an insufficient supply of liquid substrate at the heater assembly. As a result, the electric circuitry immediately ceases power supply to the heater filaments 36 and indicates to the user to replace the empty cartridge.

Alternatively, the electric circuitry may continue to monitor minimum power supply for at least one or more heating cycle. In this case, $P_{min3}$ is recorded during a third heating cycle 524 succeeding the second heating cycle 522. In this case, the difference between $P_{min3}$ and $P_{min2}$ again exceeds the predetermined $\Delta P_{offset}$ threshold, so $P_{min3}<(P_{min2}-\Delta P_{offset})$ Because the minimum power supply $P_{min}$ continues to reduce in successive cycles, the electric circuitry determines that the liquid substrate is depleted at the heater filaments 36. As a result, the electric circuitry ceases power supply to the heater assembly 30 and indicates to the user to replace the empty cartridge.

Alternatively, the electric circuitry may be configured to compare a recorded minimum power supply $P_{min}$ with one that has been recorded during the first heating cycle 520, so $P_{min1}$. In this case, the electric circuitry is configured to compare $P_{min3}$ with $P_{min1}$. If the difference between $P_{min3}$ and $P_{min1}$ exceeds the predetermined $\Delta P_{offset}$ threshold, so that $P_{min3}<(P_{min1}-\Delta P_{offset})$, the electric circuitry determines that the liquid substrate is depleted at the heater filaments 36. This ensures that comparison is always made against a cartridge that is new, or at least not depleted of liquid aerosol.

Alternatively, the electric circuitry may compare the minimum power supplied with a rolling average of minimum power supplied $P_{minAV}$ over n preceding heating cycles, where n is a positive integer greater than 1. For example, the electric circuitry is configure to average the $P_{min}$ as recorded in the last n puffs to produce said rolling average $P_{minAV}$. If the difference between $P_{min}$ and $P_{minAV}$ exceeds the predetermined $\Delta P_{offset}$ threshold, so that $P_{min}<(P_{minAv}-\Delta P_{offset})$, the electric circuitry determines that the liquid substrate is depleted at the heater filaments 36. This ensures that comparison is less likely to be affected by fluctuations in the ambient conditions.

Figure 7:
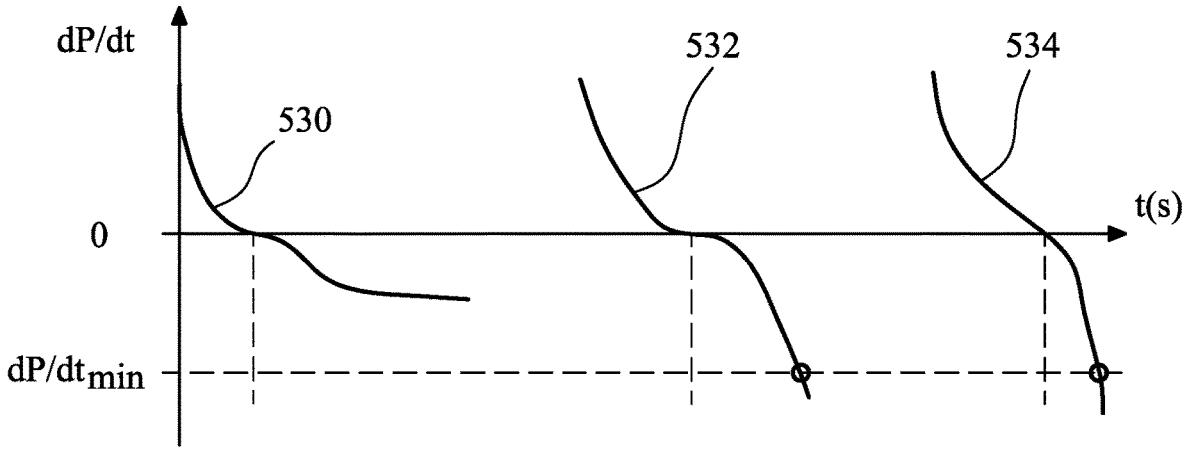
FIG. 7 is a plot showing the rate of change in power supply to the heater assembly corresponding to the multiple puffs as shown in FIG. 4 to FIG. 6.

A reduction in the minimum power supplied during the maintenance phase is a good indicator of insufficient liquid substrate at the heater filaments 36. However, the electric circuitry cannot ascertain an adverse condition until the power supply has reduced below the minimum power threshold. That is, a response to said adverse condition may not be promptly issued. In another embodiment, the electric circuitry is configured to determine insufficient liquid substrate from the first derivative of power supply with respect to time, dP/dt. This is illustrated in FIG. 7, showing the rate of change in power supply during three heating cycles corresponding to user puffs: 1) during a heating cycle 530 in which the heater filaments 36 are saturated with aerosol-forming substrate, which are normal operating conditions; 2) during a heating cycle 532 in which an insufficient supply of aerosol-forming substrate is provided to the heater filaments 36; and 3) during a heating cycle 534 in which the heater filaments are depleted of aerosol-forming substrate.

Under normal operation, when the heater filaments are saturated with liquid substrate, as shown in heating cycle 530, dP/dt gradually reduces as the heater assembly 30 heats up. Once the electrical resistance reaches the target resistance RT and is being maintained, dP/dt stays at a more or less constant level. This is because the amount of substrate vaporisation is maintained constant at the target temperature.

However if there is an insufficient supply of liquid substrate, as shown in heating cycle 532, dP/dt reduces in order to maintain the electrical resistance at the target resistance $R_T$. The electric circuitry is configured to determine an adverse condition when dP/dt reduces below a predetermined minimum rate of change threshold, $dP/dt_{min}$. For example, a sudden loss of liquid substrate supply at the heater filaments 36 would cause the power supply to reduce rapidly. This results in a decreasing dP/dt. In severe cases, dP/dt is reduced below the predetermined minimum rate of change threshold, $dP/dt_{min}$.

In the worst case scenario, when the cartridge is completely depleted of liquid substrate as shown in heating cycle 524, dP/dt reduces more rapidly and so the time to reach $dP/dt_{min}$ is shorter. The drier the heater filaments 36 the more rapidly an adverse condition is detected and the more quickly the power supply can be stopped or reduced.

The methods as described in the various embodiments may each be applied to determine an adverse condition. Alternatively, said determination of an adverse condition may be based on a combination of a plurality of the methods described. An aerosol-generating system may be configured to use different methods of determining an adverse condition in different modes. The described methods may also be used in an internal system diagnostic tool.

The invention claimed is:

1. An electrically operated aerosol-generating system, comprising:

a heating element configured to heat an aerosol-forming substrate;

a power supply configured to supply power to the heating element;

a temperature sensor configured to sense a temperature at the heating element;

electric circuitry in communication with the heating element, the temperature sensor, and the power supply, the electric circuitry comprising a memory and being configured to:

regulate a supply of power to the heating element based on the measured temperature from the temperature sensor, determine an adverse condition when a rate of change of power supplied to the heating element required to reach or maintain a predetermined temperature falls outside a predefined range, the predefined range being stored in the memory, and control power supplied to the heating element based on whether there is an adverse condition or provide an indication when there is an adverse condition; and a device and a removable cartridge, wherein the power supply and the electric circuitry are in the device and the heating element is in the removable cartridge, wherein the cartridge comprises a liquid aerosol-forming substrate, and wherein the electric circuitry is further configured to determine an adverse condition only after the temperature at the heating element has risen from an initial temperature to a target temperature.

2. The electrically operated aerosol-generating system according to claim 1, wherein the predefined range is based on a maximum threshold value of a rate of change in power supplied or a minimum threshold value of reduction in power supplied over successive heating cycles.

3. The electrically operated aerosol-generating system according to claim 1, wherein the temperature sensor is further configured to measure electrical resistance of the heating element.

4. The electrically operated aerosol-generating system according to claim 1, further comprising a puff detector configured to detect when a user is puffing on the system, wherein the puff detector is in communication with the electric circuitry, and wherein the electric circuitry is further configured to supply power from the power supply to the heating element when a puff is detected by the puff detector so that each puff corresponds to a heating cycle, and determine if there is an adverse condition during each heating cycle.

5. A method of controlling a supply of power to a heating element in an electrically operated aerosol-generating system, comprising:

measuring a temperature at a heating element;

regulating the supply of power to the heating element based on the measured temperature;

determining an adverse condition when a rate of change in power supplied to the heating element required to reach or maintain a predetermined temperature falls outside a predefined range, the predefined range being stored in a memory; and controlling power supplied to the heating element based on whether there is an adverse condition or providing an indication when there is an adverse condition, wherein the adverse condition is determined only after the temperature at the heating element has risen from an initial temperature to a target temperature.

6. A nontransitory computer-readable storage medium comprising computer program instructions stored therein, which, when executed on an internal memory of a microprocessor comprising software code portions in an electrically operated aerosol-generating system, causes the microprocessor to perform the steps of the method according to claim 5, the electrically operated aerosol-generating system comprising a heating element configured to heat an aerosol-forming substrate, a sensor configured to sense a temperature of the heating element, and a power supply configured to supply power to the heating element, the microprocessor being connected to the heating element, the sensor, and the power supply.

* * * * *